United States Patent [19]

Crandall et al.

[11] Patent Number: 5,006,078

[45] Date of Patent: Apr. 9, 1991

[54] JUMP START STUD ASSEMBLY

[75] Inventors: Jerry A. Crandall, Bluffton; James A. Witta; Stuart S. Bower, both of Fort Wayne, all of Ind.

[73] Assignee: Navistar International Transportation Corp., Chicago, Ill.

[21] Appl. No.: 484,136

[22] Filed: Feb. 22, 1990

[51] Int. Cl.[5] ..... H01R 13/52

[52] U.S. Cl. ..... 439/521; 439/750

[58] Field of Search ..... 439/519, 521, 522, 523, 439/259, 725, 838, 587, 588, 592, 750, 728, 738

[56] References Cited

U.S. PATENT DOCUMENTS

| | | | |
|---|---|---|---|
| 1,965,401 | 7/1934 | Zabach | 439/738 |
| 3,413,593 | 11/1968 | Schaefer | 439/522 |
| 4,288,504 | 9/1981 | Julian et al. | 439/522 |
| 4,421,369 | 12/1983 | Myking | 439/259 |

*Primary Examiner*—Joseph H. McGlynn
*Assistant Examiner*—Hien D. Vu
*Attorney, Agent, or Firm*—F. David AuBuchon; Dennis K. Sullivan

[57] ABSTRACT

A jump start stud assembly comprises a tin plated brass stud having a plastic insulating body molded around a medial portion thereof for mounting to the vehicle. The stud assembly includes a cylindrical cap which covers a jumper cable contact end of the stud and releasably engages an adjacent end portion of the insulating body. The stud assembly also includes a boot member which has one end thereof sealed against an insulator of a cable extending therethrough into electrical communication with the other end of the stud with the other end of the boot member engaging an adjacent end of the insulating body. The stud assembly thus formed provides a stud which may be completely isolated from the ambient environment when not in use.

23 Claims, 1 Drawing Sheet

JUMP START STUD ASSEMBLY

BACKGROUND OF THE INVENTION

The present invention relates to a jump start stud assembly provided on the body of a vehicle, such as a truck, which is used for connection of vehicle starting circuitry to an external source of electrical energy when it becomes necessary to supplement the energy produced in the vehicle battery to start the truck.

THE PRIOR ART

Heretofore, jump start stud assemblies have been used in connecting an external source of electrical energy to a starting circuit for a truck engine. Such prior assemblies have not provided for complete sealing of the stud to protect it from corrosive elements within the ambient environment, such as salt spray, inasmuch as the stud assembly is typically mounted in splash area of the vehicle, such as on the battery box of a truck. Known stud assemblies have included a brass stud incorporating a plastic mounting body surrounding the stud, creating a two piece assembly which allows corrosive elements to invade the space between the stud and the plastic body.

SUMMARY OF THE INVENTION

As will be described in greater detail hereinafter, the stud assembly of the present invention includes a plastic mounting body insert molded around the stud and a plastic mounting nut which seats thereagainst to mount the assembly to the vehicle structure. Also, an insulator cap member is provided which seats around the exterior contact end of the stud and seals against the plastic body, keeping corrosive elements off the stud. Further, a boot member seats around a battery cable mounting end of the stud sealing at one end against the plastic body of the study and at the other end around the cable secured to the stud, keeping corrosive elements off the structures at the cable mounting end of the assembly. Finally, the brass stud of the assembly is plated in tin, to help deter corrosion of the stud.

DESCRIPTION OF THE PREFERRED EMBODIMENT

Figure 1:
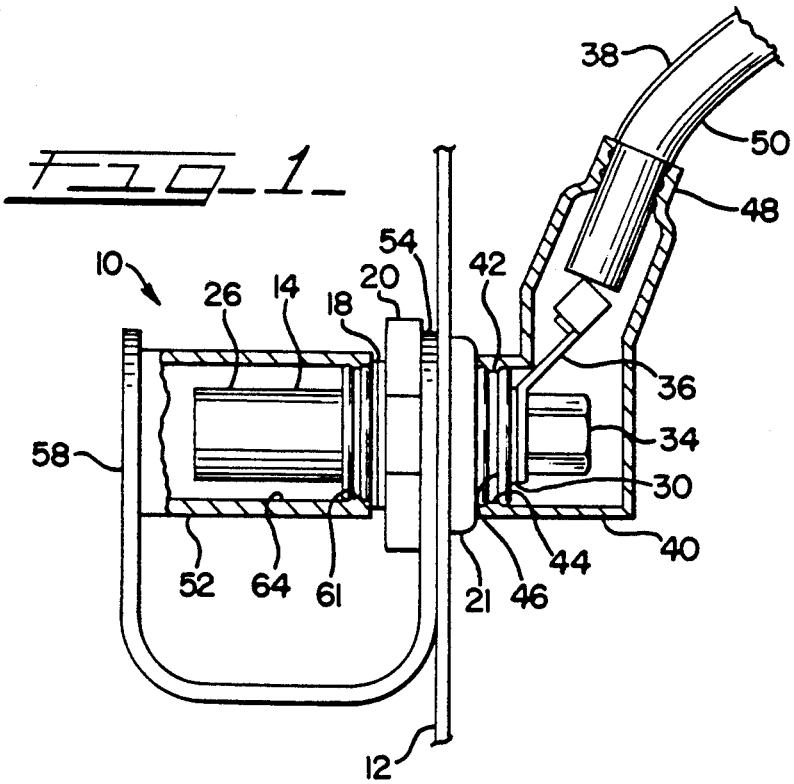
FIG. 1 is a side view of the stud assembly of the present invention shown mounted to a vehicle structure, such as a cab side wall with portions broken away to show structure within the plastic insulator cap member and the plastic boot thereof.
Figure 2:
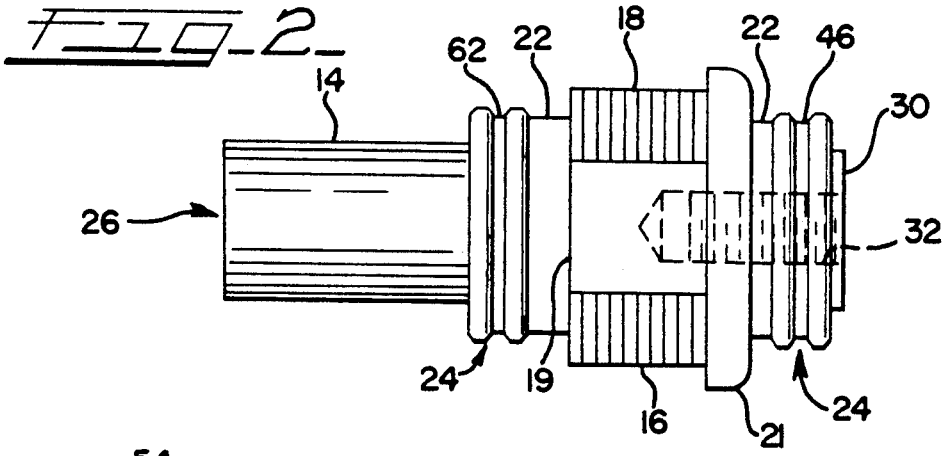
FIG. 2 is an enlarged plan view of a stud and surrounding plastic mounting body of the stud assembly of FIG. 1.

Referring now to the drawings in greater detail, there is illustrated in FIG. 1 the jump start stud assembly 10 of the present invention. The assembly 10 is shown mounted to and through a wall 12 of a vehicle structure, such as a battery box or a bracket provided on the rear wall of the truck cab. The stud assembly 10 includes a stud 14 surrounded along a significant portion of its length by an insulating body 16 made of a plastic material such as nylon. The stud 14 is made of brass and is plated with tin to deter corrosion thereof.

The insulating body 16 includes a threaded hub portion 18 having opposed radial flat sections 19 to provide recess engaging surfaces for the body 16. In this respect, although not shown, a recess or opening formed in the structure wall 12 for receiving the assembly 10 therein is undercut along opposite peripheral areas to create opposed planar edges against which the radial flat sections 19 of the hub portion 18 abut to prevent rotation of the assembly 10 while a mounting nut 20 is screw threaded over the hub portion 18 of the insulating body 16 in attaching the stud assembly to the vehicle. The hub portion 18 further includes an annular flange 21 which abuts against a surface of the wall 12 to secure the assembly 10 against same as the nut 20 is threaded over the end of the hub portion 18.

Extending longitudinally outwardly from each end of the hub portion 18 is a circumferential collar portion 22 of smaller diameter than hub portion 18, each collar portion 22 terminating in a circumferential double ridge section 24.

An exterior cylindrical contact end 26 of the stud 14 extends outwardly from the end of the insulating body 16 opposite the flange 21 while a battery cable mounting end 30 of the stud 14 extends slightly outwardly from the collar portion 22 at the end of the insulating body 16 interior of the vehicle wall 12. The cable mounting end 30 of the stud 14 includes a threaded central bore 32 within which a bolt 34 will be received to secure a terminal end 36 of battery cable 38 to the stud 14, the opposite end of cable 38 being attached to the vehicle battery or batteries.

The stud assembly 10 further includes an elastomeric boot 40 which surrounds and seats over the engaged cable and stud at the cable mounting end 30 of the stud assembly 10. The end edge 42 of the boot is provided with an inwardly directed circumferential flange 44 which is received, in snap-fit sphincteral engagement within a groove 46 formed on the surface of the insulating body 16 within the double ridge section 24 thereof, thus creating a seal therebetween. The boot 40 is somewhat L-shaped and the other end 48 thereof is adapted to engage with and seal against an outer insulated surface 50 of the battery cable 38. The cable extends into the boot 40 and is electrically engaged to the stud 14 as described above.

Inasmuch as the boot 40 is engaged to a movable cable and over an electrical circuit connection, it will be understood that the boot 40 is to be made of a plastic or elastomeric insulating material, such as chloroprene, which will not be compromised by contact with ambient environmental elements such as water, salt or cold. The boot 40 creates an environment for the cable mounting end 30 of the stud 14 which is isolated from the ambient environment, maintaining the structures therein less likely to corrode.

Figure 3:
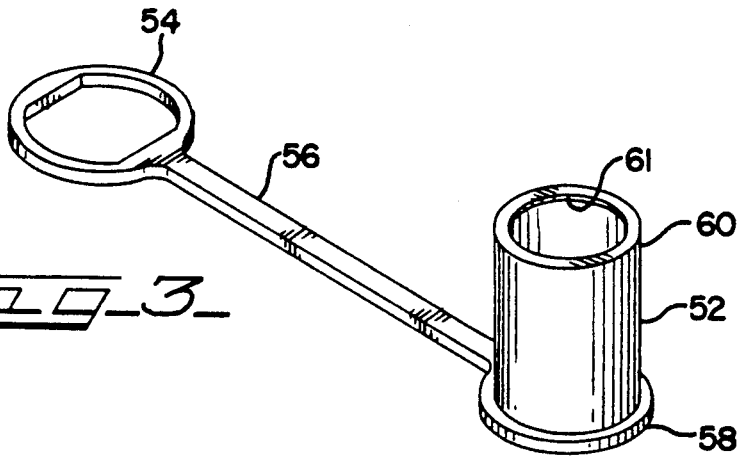
FIG. 3 is a perspective view of the insulator cap member of FIG. 1.

Turning now to the contact end 26 of the stud 14, it will be seen from FIGS. 1 and 3 that, when the stud assembly 10 is mounted within the opening in the structure wall 12, the exterior contact end 26 of the stud 14 is fed through the opening in the wall 12 until the flange 21 abuts the surface of the wall 12. An insulator cap member 52 is secured to the stud assembly 10 by means of a plastic washer element 54 having a radial arm 56 extending therefrom which is integrally formed at its other end with a closed end surface 58 of the cap member 52, the washer element 54 being compressed between the mounting nut 20 of the assembly 10 and the wall 12. Engagement of the washer element 54 within the mounted assembly 10 assures against loss of the cap member 52 when it is removed from engagement over the contact end 26 of the stud 14 to allow access thereto.

The cap member 52 is an elastomeric hollow cylindrical structure 52 having a closed end 58 and an open end 60 and has an inner wall 64 provided adjacent open end 60 with an inwardly directed annular flange 61. This flange 61 sphincterally engages collar 22 at the contact end 26 of the stud member 14 within a groove 62 formed by the double ridge section 24 thereon to sealingly cover the stud, the cap member 52 being removably secured over the stud 14 in a snap fit manner of engagement. Inasmuch as the cap member 52 must be able to be disengaged from the insulating body 16, it must be made of a material capable of being deformed at temperatures as low as approximately −40° F., preferably a neoprene, such as Santoprene® sold by Monsanto, to assure integrity during removal and reinstallation thereof.

Thus, there has been provided, in accordance with the invention, a jump start stud assembly 10 which assures for total isolation of the stud 14 from the ambient environment as well as providing for isolation of the battery cable 38 as well as its connection to the stud assembly. It will be appreciated the vehicle will commonly be provided with two such stud assemblies, one for the supply side and one to the ground side of the electrical system.

As described above, the stud assembly 10 of the present invention has a number of advantages, some of which have been described above and others of which are inherent in the invention. Also, it will be apparent to those of ordinary skill in the art that modifications may be made to the stud assembly 10 without departing from the teachings of the present invention. Accordingly, the invention is only to be limited as necessitated by the accompanying claims.

What is claimed is:

1. A jump start stud assembly which is mountable on a vehicle surface away from the starting circuit of the vehicle, but electrically engaged thereto, said stud assembly comprising:

a conductive stud;

a cylindrical nonconductive insulating body molded around a medial portion of said stud between exposed ends thereof, said insulating body having a distal end and a proximal end, said insulating body including a threaded main hub portion and distal and proximal collar portions of smaller diameter than said hub portion disposed respectively at each end thereof;

a nonconductive boot sealingly fixed over a proximal end of said stud assembly, said boot being secured at one end to insulation of a battery cable electrically engaged to said stud at said proximal end thereof, the other end of said boot being sealingly secured to said proximal collar of said insulating body; and an insulating cap releasably covering the distal end of said conductive stud for isolating said stud from the ambient environment.

2. The stud assembly of claim 1 wherein said insulating cap releasably sealingly engages said distal collar of said insulating body.

3. The stud assembly of claim 2 wherein the periphery of said distal collar includes an annular detent, said cap being sphincterally engaged therewith.

4. The stud assembly of claim 3 wherein said insulator cap is made of an elastomeric material deformable at low temperatures.

5. The stud assembly of claim 3 wherein the periphery of said distal collar includes an annular detent, said cap being sphincterally engaged therewith.

6. The stud assembly of claim 2 wherein said stud is made of brass plated with tin.

7. The stud assembly of claim 6 wherein said boot is made of plastic.

8. The stud assembly of claim 2 wherein said insulator body is made of a plastic material.

9. The stud assembly of claim 8 wherein said plastic body is molded around said stud.

10. A jump start stud assembly adapted to be mounted to a vehicle body including:

a stud made of conductive material, said stud having a first end including connecting means for attaching a vehicle battery cable thereto and an exposed end;

a cylindrical insulator body surrounding a medial portion of said stud, said insulator body including mounting means thereon for attaching said stud assembly to a vehicle wall;

a boot engaged with said insulator body for covering said connection means end of said stud; and a removable cap releasably engaged with and supported by said insulator body and sealingly covering said exposed end of said stud.

11. The stud assembly of claim 10 wherein said insulator body mounting means includes a threaded main hub portion terminating in a radial flange disposed at said connection means end thereof.

12. The stud assembly of claim 11 wherein said insulator body terminates at both ends thereof in a reduced diameter collar portion.

13. The stud assembly of claim 12 wherein said stud assembly is mounted to a battery box of a truck.

14. The stud assembly of claim 12 wherein said stud assembly is mounted to a rear wall of a truck cab via a mounting bracket.

15. The stud of claim 12 wherein said detent is defined by a pair of adjacent raised annular ridges disposed on said surface.

16. The stud of claim 12 wherein said hub portion is provided with said collar portion at both said cable mounting end and at said contact end of said stud.

17. The stud assembly of claim 12 wherein said boot includes an annular flange on an inner surface thereof which is received within an annular groove disposed on an outside surface of said collar at the connection means end of said insulator body.

18. The stud assembly of claim 17 wherein the other end of said boot is disposed to be crimped about the insulating sleeve of a battery cable engaged to said stud.

19. The stud assembly of claim 12 wherein said cap has a closed end, a washer element secured to the stud assembly, and an integral connecting portion which extends between said cap and said washer element.

20. The stud assembly of claim 19 wherein opposite radial areas of said hub portion are undercut to provide two flats in the periphery thereof.

21. The stud assembly of claim 12 wherein the exposed end collar of said insulating body includes engagement means thereon for releasably engaging an open end of said cap member.

22. The stud assembly of claim 21 wherein said cap includes an annular flange on an inner surface thereof which sphincterally engages said engagement means on said collar.

23. A jump start stud which is mountable to and through a wall of a vehicle structure and electrically engageable to a starting circuit of a vehicle, said stud assembly comprising:

a stud, having a cable mounting end and a contact end; and an insulating plastic body molded around a medial portion of said stud between exposed ends thereof, said insulating body having a threaded hub portion having a radially extending mounting flange adjacent one end thereof and a collar portion integral therewith on the contact side thereof, said collar portion having a cylindrical periphery of smaller diameter than said hub portion and including a stud cap sealing engagement means comprising an annular detent thereon adjacent a distal end of said collar.

* * * * *